United States Patent [19]

Wardlaw

[11] Patent Number: 4,721,146

[45] Date of Patent: Jan. 26, 1988

[54] ROLLING DOOR OPERATING MECHANISM

[75] Inventor: Russell Wardlaw, San Rafael, Calif.

[73] Assignee: The Cookson Company, San Francisco, Calif.

[21] Appl. No.: 2,573

[22] Filed: Jan. 12, 1987

[51] Int. Cl.[4] ..... A47G 5/02

[52] U.S. Cl. ..... 160/310; 160/312; 74/625

[58] Field of Search ..... 160/310, 311, 312, 133, 160/188, 189, 193; 74/625, 405

[56] References Cited

U.S. PATENT DOCUMENTS

| | | | |
|---|---|---|---|
| 2,390,117 | 12/1945 | Michelman | 160/312 X |
| 2,622,452 | 12/1952 | Michelman | 74/625 |
| 2,670,065 | 2/1954 | Stevens | 74/625 X |
| 2,819,628 | 1/1958 | Wardlaw | 74/625 |
| 2,934,139 | 4/1960 | Wardlaw et al. | 160/133 X |
| 2,957,521 | 10/1960 | Greegor | 160/133 |
| 3,134,273 | 5/1964 | Wardlaw | 74/625 |
| 3,637,004 | 1/1972 | Wardlaw et al. | 160/133 |
| 3,853,167 | 12/1974 | Wardlaw | 160/188 X |

*Primary Examiner*—Ramon S. Britts
*Assistant Examiner*—David M. Purol
*Attorney, Agent, or Firm*—Donald N. MacIntosh; Harold C. Hohbach; Richard E. Backus

[57] ABSTRACT

A clutch or rolling door operating mechanism permits use of two sources of power for moving the door between open and closed positions. A drive gear rotates about an eccentrically mounted shaft which itself is turned through a clutch of the fixed drag type to swing the gear into engagement with the drive train for moving the door via manual power and to permit the gear to swing into disengagment with such drive train for moving the door by electric power operation. In one form a circuit interlock prevents motor operation during manual driving of the door; in a second form an audible "clacker" sounds to indicate manual operation of the operating mechanism.

10 Claims, 6 Drawing Figures

FIG-4
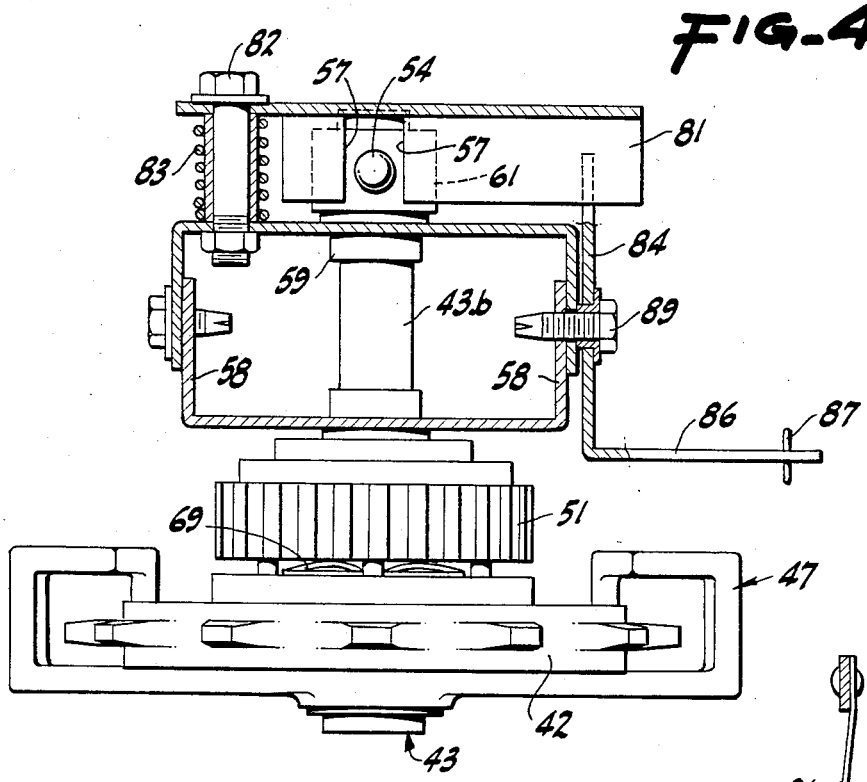
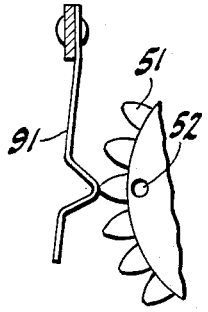
FIG-6
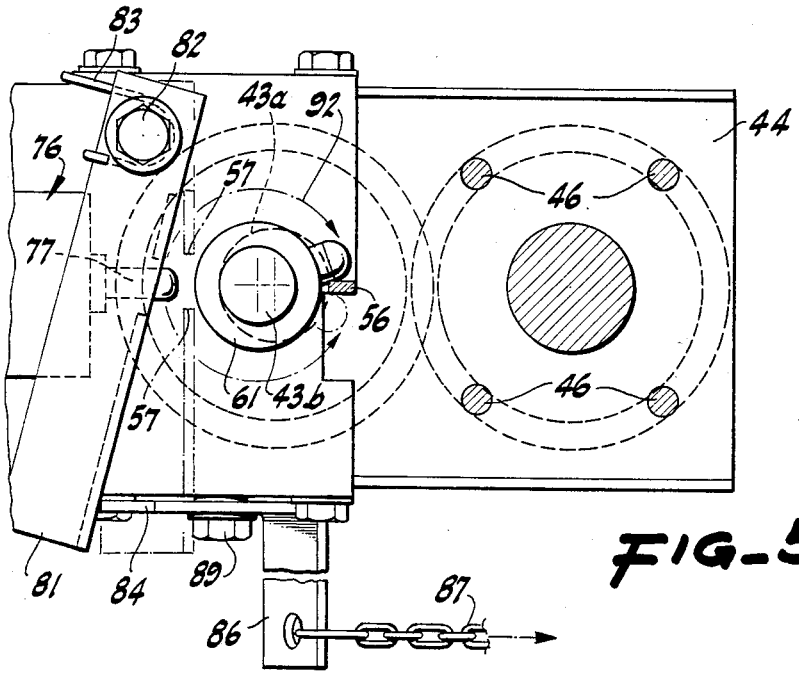
FIG-5

ROLLING DOOR OPERATING MECHANISM

BACKGROUND OF THE INVENTION

This invention relates generally to an operating mechanism for rolling doors and the like and more particularly to novel driving mechanisms permitting the safe operation of the door in either the manual drive or motor drive mode.

A rolling door structure consists of an articulated curtain arranged to be raised and lowered to open or close a doorway, window or other opening in a building. In new building construction especially, the rolling doors may be installed before the electric power is made available for driving the door using the motor operator. Consequently there is a need for a manual drive mechanism for operating the door independently of whether electric power is available to drive the motor operator. For example, periodic servicing of the motor operator may require that the door be manually operated and on those occasions of electrical power outtage, including those during or following a fire, make a manually operated door a valuable feature.

To ensure that the mechanism for manually operating the door will stand idle during motor operation of the door, it is important that there be a provision for disengaging the manual drive operator from the motor drive operator when the motor drive is needed. An efficient arrangement for manually operating a rolling door mechanism is to couple the manual drive with the motor drive and thus it is highly desirable to be able to selectively engage and disengage the manual drive from the motor drive as the need arises.

Rolling doors may be constructed as exemplified by U.S. Pat. No. 2,820,516 and include operating mechanisms as exemplified by U.S. Pat. Nos. 3,637,004, 3,853,167 and 2,934,139, all owned by the present assignee.

SUMMARY OF THE INVENTION AND OBJECTS

In summary, the invention concerns a rolling door operating mechanism for moving a rollable curtain between raised and lowered positions and including a frame having drive means mounted thereon for driving the rollable curtain from a first power source and including a gear synchronously rotatable with respect to movement of the curtain. Second drive means are provided for driving the curtain from a second power source such as manual power and including a shaft bi-directionally rotatable and mounted on the frame. A drive gear is rotatably arranged on the shaft for selective driving engagement with the first gear and the shaft is provided with abuttment means fixedly arranged thereon for engagement with first and second stop means for arresting rotation on the shaft when driving the curtain from either said first or second power source respectively. Clutch means are arranged to permit the drive gear to rotate the shaft when the shaft abuttments immobilize the shaft from moving in a given direction and an eccentric portion of the shaft serves to revolve the drive gear into and out of engagement with the first mentioned gear.

A general object of the invention is to provide an improved operating mechanism for a rolling door or the like which mechanism is most frequently operated from an electric power source but yet is adapted readily for operation by manual power.

Another object of the invention is to provide an operating mechanism of the type described and incorporating a highly simplified and efficient manual drive system.

Still another object is to provide an operating mechanism of the type described which includes safety provisions for locking out the electric mechanism when the manual drive is selected for use.

In connection with the foregoing object, yet another object is to provide for readily shifting from motor drive to manual drive mode and vice versa in a safe and positive manner and generating an audible signal when the manual drive mode is effective.

Additional objects and features of the invention will appear from the following description where the preferred embodiments are set forth in detail and are illustrated in the accompanying drawings.

BRIEF DESCRIPTION OF DRAWINGS

FIG. 4 is a sectional view in the direction of the arrows 4—4 of FIG. 2.

FIG. 5 is a view like FIG. 3 but illustrating the manual drive mode of the operating mechanism.

FIG. 6 is a fragmentary sectional view taken in the direction of the arrows 6—6 of FIG. 2 and showing a "clacker" used in another embodiment of the invention.

DESCRIPTION OF THE PREFERRED EMBODIMENT

Figure 1:
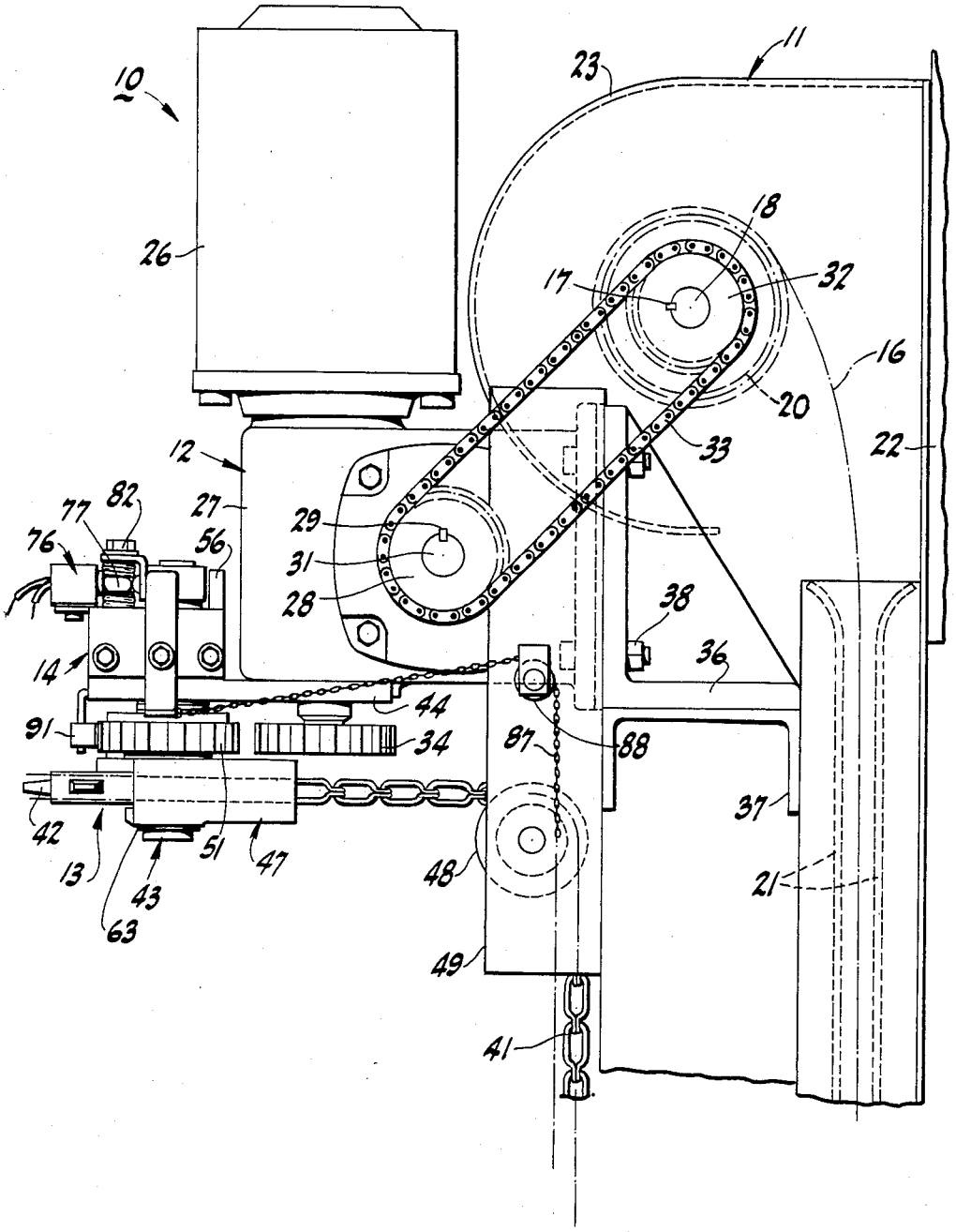
FIG. 1 is a side elevation view illustrating a rolling door operating mechanism containing the present invention.

A preferred embodiment 10 of the invention is shown in FIG. 1 of the drawings arranged in operative association with a rolling door 11 and an operating mechanism 12 which includes a hand chain mechanism 13 which cooperates with a motor drive 12 through a coupling-uncoupling mechanism 14. The arrangement is such that the rolling door 11 may be raised and lowered using the motor drive 12 or the hand chain drive 13 acting through the coupling mechanism 14 as will be described more fully below.

The rolling door 11 comprises a rollable, articulated curtain 16 arranged to coil upon the barrel 20 which is connected by a key 17 to a shaft 18 which is suitably journaled and supported with respect to the building 19 having the door or other opening which is secured by the rolling door assembly. The sides of the rolling door curtian 16 are received in curtain guides 21 the upper portions 22 of which are flared for unobstructed entry of the curtain. The curtain guides 21 are mounted on opposite sides of the doorway or other opening 22 with the rolling curtain barrel assembly disposed above the lentil 22. A hood 23 encloses and protects the curtain and barrel assembly.

The curtain 16 may comprise, for example, an arrangement of interlocking slats fabricated from a suitable material such as cold-rolled steel, or a grill constructed as disclosed in U.S. Pat. No. 2,940,520 issued on an application by Harold W. Cookson, Jr. and Russell Wardlaw. The subject mechanism of this invention is also useful on vertical lift and sectional doors as well as most types of rolling doors.

The motor drive 12 includes an electric motor 26 operatively coupled to a gear reduction unit 27 which is bi-rotational. The gear reduction unit 27 has an output sprocket 28 secured by a key 29 to an output shaft 31. The main shaft 18 of the rolling door assembly is similarly equipped with a driven sprocket 32 and a drive chain 33 is reeved upon the sprockets 28, 32 so that the rolling door 11 may be driven by the motor drive 12 for opening and closing the door.

In addition to the output drive sprocket 28 the gear reduction unit has an auxilliary gear 34 which is arranged in the gear reduction unit 27 to turn in synchronization with the output drive sprocket 28. Thus as the sprocket 28 is rotated by action of the electric motor 26 the auxilliary gear 34 rotates and conversely when the auxilliary gear 34 is rotated through use of the hand chain drive 13, to be described fully below, the output sprocket 28 is rotated for either raising or lowering the articulated curtain 16. As shown in FIG. 1, the motor drive and hand chain drive are mounted as a unit to a structural angle member 36 fixedly secured to a horizontal extending channel-shaped structural support 37 which is rigid with the building. Conventional fasteners 38 can be used to secure the mounting portions of the motor drive 12 to the member 36.

Figure 2:
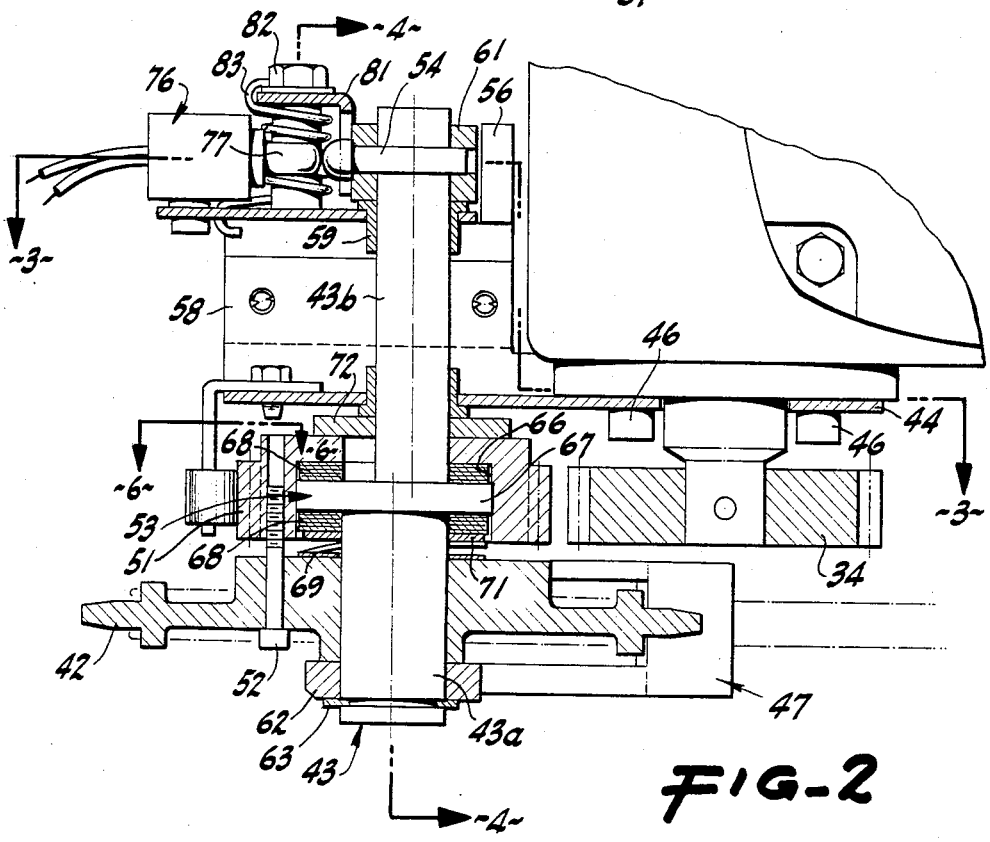
FIG. 2 is a fragmentary sectional view taken in the direction of the arrows 2—2 in FIG. 3.

The hand chain drive 13 and the coupling/uncoupling mechanism 14 are shown in FIGS. 1 and 2 and include an endless hand chain 41 arranged to drive a hand chain sprocket 42 rotatably mounted on an eccentric shaft 43 which is journaled to a frame member 44 fixedly secured to the gear reducing reduction unit 27 by the fasteners 46.

A guard 47 is provided for the hand chain sprocket 42 and a spaced pair of idler sprockets 48, arranged in a frame 49, direct the hand chain 41 between vertical and horizontal directions of travel.

Figure 3:
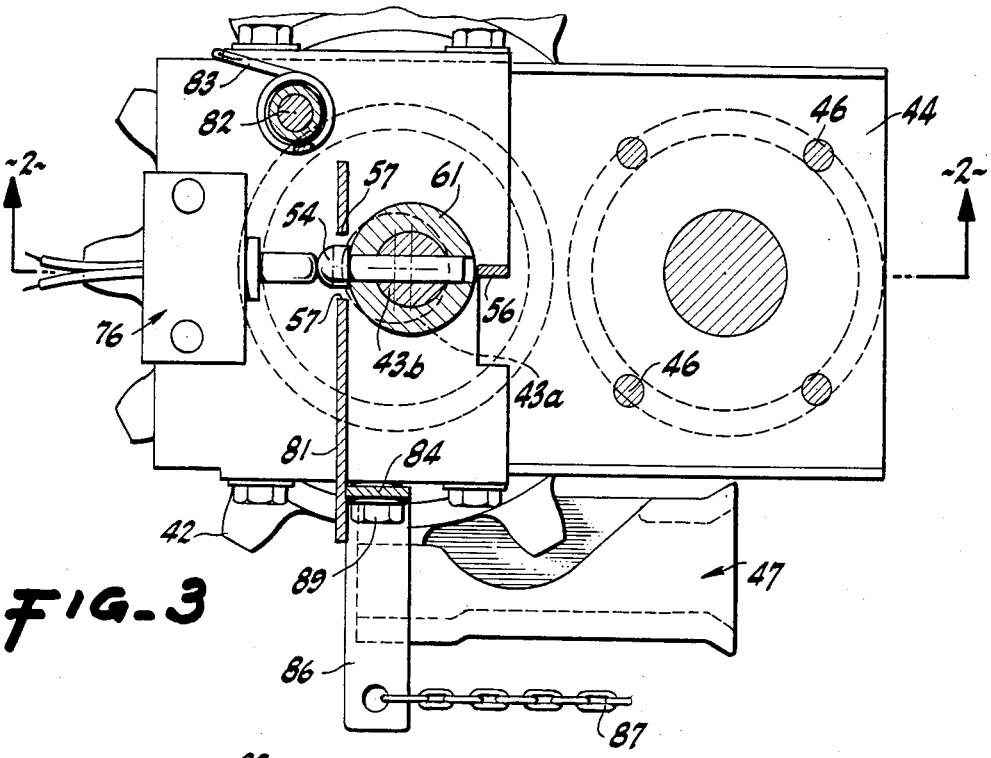
FIG. 3 is a sectional view in the direction of the arrows 3—3 of FIG. 2.

The coupling/uncoupling mechanism 14 includes the previously mentioned eccentric shaft 43, a manual drive gear 51 secured to the end chain sprocket 42 by the cap screws 52, and a drag clutch 53 which serves to permit the eccentric shaft 43 to rotate bi-directionally. This action brings a switch actuation member 54 on the shaft 43 into engagement either with a first stop means 56, as shown in FIG. 5, or into retained engagement by a second stop means 57, FIGS. 2 and 3. The rotation of the shaft 43 will bring the gears 34 and 51 together meeting at the pitch circle or dispose those gears in the disengaged condition as indicated in FIGS. 2 and 3. It will be understood that when the gears are disposed as shown in FIG. 5 the hand chain drive may be employed to rotate the input/output gear 34 for either raising or lowering the articulated curtain 16. Conversely, when the gears 34, 51 are disposed as illustrated in FIGS. 2 and 3, the output gear 34 is disengaged from the manual drive gear 51 and the rolling door 11 is operated in the motor drive mode and independently of the manual chain drive.

More specifically, the eccentric shaft 43 includes the lower concentric section 43A and an upper section 43B eccentrically arranged with respect to the lower section 43A, FIGS. 2 and 3. The shaft portion 43B is journaled in frame members 58 by the two bushings 59. A set collar 61 rotates against the upper bushing 59 and is mounted to vertically locate the shaft 43. The lower or concentric portion 43A of the shaft rotatably supports the hand chain sprocket 42 coupled to the manual drive gear 51. A collar 62 secured by a snap ring 63 serves to maintain the shaft 43, sprocket 42 and gear 51 in the desired operative relation. It should be understood that neither the sprocket 42 nor the gear 51 is keyed to the shaft 43, but the gear 51 is coupled to the shaft through the drag clutch 53.

More particularly, the drag clutch 53 is arranged within a cavity 66 formed in the lower radial surface of the drive gear 51. The clutch 53 includes a cylindrical clutch plate 67 concentrically arranged with respect to portion 43A of the eccentric shaft. A pair of friction discs 68 is disposed in the cavity 66, one on each face of the clutch plate 67, as shown in FIG. 2. A wave spring 69 acts between a radial face of hand chain sprocket 42 and a thrust washer 71, which engages the face of the lower friction disc 68. The spring 69 has sufficient force that when the clutch spacings are appropriately set through adjustment of the cap screws 52, the friction discs 68 will apply sufficient frictional forces to the clutch plate 67 to rotate the shaft 43. In other words, rotation of the hand chain sprocket 42 and manual drive gear 51, will cause rotation of the eccentric shaft 43 until one of the two stop means 56, 57 is encountered. When this occurs, the clutch will simply create a drag on the rotation of the gear 51.

In one preferred embodiment of the invention an interlock switch 76 is included to prevent operation of the drive motor 12 when the hand chain drive 13 is selected for moving the articulated curtain 16. The switch 76 is secured to the frame member 58 and includes a plunger 77 which acts to close or open a control circuit through the switch for operation of the motor. As illustrated in FIG. 3, the plunger is urged into a retracted position by the protuberance of the switch actuation arm 54 to close a circuit permitting operation of the motor drive 12. As illustrated in FIG. 5, the plunger 77 extends from the body of the switch 76 when the switch actuation member 54 is moved away from the plunger thus creating an open circuit precluding delivery of electric power to the motor drive 12. This ensures a safe electrical lock-out mechanism which ensures that the motor drive will not be inadvertantly actuated during the period when the hand chain drive 13 is selected for use.

Mentioned above was that a second stop means 57 serves to arrest the protuberance on the switch actuator 54 and referring specifically to FIGS. 3 and 5, it will be observed that a pivotally movable release arm 81 is mounted to the frame 58 by a fastener 82 and is biased by a coil spring 83 in a counterclockwise direction as viewed in FIGS. 3 and 5 so as to engage an upwardly extending arm 84 of a release lever 86. As shown in FIGS. 1 and 3, a hand chain 87 reeved over a idler sprocket 88 is connected to the release lever 86 which is mounted on the frame 58 for pivotal movement by the fasteners 89. The arrangement is such that pulling on the hand chain 87 serves to pivot the release lever 86 rotating the laver arm 84 against the release arm 81 moving it against the bias of the spring 83 to the position illustrated in FIG. 5. This has the effect of moving the second stop means 57, a slot in the vertical leg of the angle shaped release arm 81, to an out-of-the-way position with respect to the switch actuation arm 54 permitting its rotation via the shaft 43 to either the position illustrated in FIG. 5 or to a similar position abutting the opposite side of the stop means 56, a flange on the frame 58, from that illustrated in FIG. 5.

In another preferred embodiment of the invention a "clacker" 91 is arranged on the frame 58, FIGS. 1, 2 and 6, for engagement with the teeth of the manual drive gear 51. The clacker is formed preferably of spring steel fastened at one end to the frame 58 and with a vee portion disposed to engage with the teeth of the gear wherein rotation of the manual drive gear 51 will produce a clack, clack, clack sound as the gear is rotated. This serves as an audible signal that the manual chain drive is engaged and alerting an operator that the electric drive should not be engaged. In this embodiment the interlock switch 76 is not employed in the power circuit to the motor drive.

OPERATION

The operation of the unit is briefly described below.

The invention 10 acting in the motor drive mode is illustrated in FIGS. 1–3 wherein the interlock switch 76 is engaged by the switch actuation arm 54 to maintain the switch 76 in a closed position for supplying electric power to the motor drive 12. The output sprocket 28 carried by the output shaft 31 serves to drive through the chain 33 the sprocket 32 thus rotating the shaft 18 to coil or uncoil the articulated curtain 16 for opening or closing the doorway secured by the rolling door 11. It will be understood that the motor drive 12 operates in both directions and that the input/output gear 34 rotates in synchronization with the output shaft 31 and sprocket 28. In the motor operation mode the gears 34 and 51 are spaced apart as indicated in FIGS. 1–3 and the hand chain drive 13 is inactive.

When selecting the hand chain drive mode for operating the rolling door 11, such as when conducting maintenance or during an electric power outage, it is first necessary to unlock the eccentric shaft 43 which is captured by the action of the protuberance on the switch arm 54 residing in the slot of the second stop means 57 on the release arm 84. In other words, the shaft 43 is constraining against rotation by engagement of the switch arm and the second stop means although it is nevertheless possible to rotate the hand chain sprocket 42 and manual drive gear 51 as permitted by the drag clutch 53. The gears 51 and 34, though, will be in a nonengaging relationship as long as the arm 54 remains seated in the slot established by the second stop means. A pull on the hand chain 87 will release the member 54 from the slot in the release arm 81. A pull on the chain 84 pivots the release lever 86 urging the arm 84 against the release arm 81 against the bias of the coil spring 83 into the position of the arm 81 as shown in FIG. 5. Once the member 54 is disnegaged from the release arm 81, a pull on the endless chain 41 will cause the eccentric shaft 43 to rotate through action of the drag clutch 53 such that the manual drive gear 51 will be rotated into meshing engagement with the input/output gear 34 of the gear reduction unit 27, as indicated in FIG. 5. The switch actuation arm 54 then abbuts the stop member 56 on the frame, arresting further rotation of the eccentric shaft in the selected direction as indicated by the arrow 92, FIG. 5. Continued pulling on the hand chain 41 will cause rotation of the input/output gear 34 which is then coupled with the gear reduction unit 27 to drive the output sprocket 28 and will serve to move the articulated door in the manner described above in connection with the motor drive mode.

To shift from the manual drive mode to the motor drive mode, the release arm 81 and release lever 86 are permitted to assume the positions illustrated in FIG. 3. This occurs through action of the coil spring 83 and the release of the pulling force from the release hand chain 87. Use of the main hand chain 41 then will rotate the eccentric shaft 43 through action of the drag clutch 53 which will rotate the gears 34 and 51 into a disengaged condition, as shown in FIG. 2, and bring the protuberance of member 54 into the confines of the release arm 81 as indicated in FIG. 3. The position of the protuberant portion of the member 54 against the plunger of the interlock switch 77 permits electric power to be supplied to the motor drive unit 12 for operating the door.

When an electric circuit is supplied without the interlock switch 76, the audible clacker 91 is provided, as mentioned above. In that configuration it is possible for the electric motor drive to be actuated while the gears 34 and 51 are in an engaged condition. It will be understood that in this event the rotation of the gear 34 by the electric motor will rotate the gear 51 less than one whole revolution before the eccentric shaft is rotated into the position shown in FIG. 2 and the member 54 is captured by the release arm 81 as indicated in FIG. 3. During that short interval the clacker provides a warning signal indicating that the hand chain 41 should not be touched as it moves the short distance before gears 51 and 34 disengage.

As is apparent from the above description and from the drawings, the several objects of the invention are achieved and other advantageous results are obtained.

As various changes could be made in the above construction without departing from the scope of this invention, it is intended that all matter contained in the above description or shown in the accompanying drawings shall be interpreted as illustrative and not in a limiting sense.

What is claimed is:

1. A rolling door operating mechanism for moving a rollable curtain or the like between raised and lowered positions, comprising a frame, first means mounted on said frame for driving the rollable curtain from a first power source between such positions and including first gear means synchronously rotatable with movement of the curtain, switch means serving to couple and uncouple said drive means from the power source, second means for driving the curtain from a second power source in lieu of said first power source and including a shaft rotatably mounted on said frame; said shaft having a drive gear rotatably arranged thereon for selective driving engagement with said first gear means, means serving to rotate said drive gear, switch actuation means on said shaft arranged for selective engagement with said switch means, first stop means arranged for engagement with said switch actuation means for arresting rotation of said shaft when driving the curtain from said second power source, second stop means arranged for engagement with said switch actuation means serving to arrest rotation of said shaft when driving the curtain from said first power source, means serving to shift said second stop means to become disengaged from said switch actuation means when driving the curtain from said second power source, and clutch means serving to permit said drive gear to rotate on said shaft when said switch actuation means engages either said first or second stop means and serving to rotate said shaft for moving said switch actuation means to or from said stop means.

2. The rolling door operating mechanism of claim 1 wherein said shaft includes means rotatably mounting said drive gear eccentric with the shaft axis, whereby rotation of said shaft for moving said switch actuation means to or from said stop means serves to engage or disengage said drive gear with respect to said first gear means.

3. The apparatus of claim 2 wherein said clutch means includes a clutch member rigid with said shaft, friction means acting between said clutch member and said drive gear, and spring means serving to bias said friction means against said clutch member and said drive gear.

4. The apparatus of claim 2 wherein said first means include an electric motor equipped with a speed reduction drive, and said second means includes a hand chain drive.

5. An operating mechanism for moving a rollable curtain or the like between raised and lowered positions, comprising a frame, first means mounted on said frame for driving the rollable curtain from a first power source between such positions and including first gear means synchronously rotatable with respect to the movement of the curtain, second means for driving the curtain from a second power source in lieu of said first power source and including a shaft rotatably mounted on said frame, said shaft having a drive gear rotatably arranged thereon for selective driving engagement with said first gear means and having abuttment means fixedly arranged thereon, means serving to rotate said drive gear, first stop means arranged for engagement with said shaft abuttment for arresting rotation of said shaft when driving the curtain from said second power source, second stop means arranged for engagement with said abuttment serving to arrest rotation of said shaft when driving the curtain from said first power source, means serving to shift said second stop means to become disengaged from said shaft abuttment when driving the curtain from said second power source, and clutch means serving to permit said drive gear to rotate on said shaft when said shaft abuttment engages either said first or second stop means and serving to rotate said shaft for moving said shaft abuttment to or from said stop means.

6. The apparatus of claim 5 and including signal tone generating means on said frame serving to create an audible tone upon rotation of said drive gear.

7. The apparatus of claim 5 wherein the means serving to rotate said drive gear includes a sprocket connected to said drive gear, a hand drive chain reeved on said sprocket for manually driving the curtain in lieu of said first power source.

8. The apparatus of claim 5 wherein said means serving to shift said second stop means includes a release arm pivotally mounted with respect to said frame, and means serving to pivot said release arm to shift said second stop means for engagement or disengagement with said shaft abuttment.

9. The operating mechanism of claim 8 wherein said last mentioned means includes a release lever pivotally mounted on said frame for engagement with said release arm and a hand chain connected to said release lever for pivoting same against said release arm for effecting engagement or disengagement thereof with said shaft abuttment.

10. The operating mechanism of claim 5 wherein said shaft includes a first portion journalled on said frame and carrying said shaft abuttment means and a second portion arranged eccentrically with said first portion and carrying said drive gear whereby rotation of said shaft from said first power source serves to rotate said drive gear into a disengaging relationship with respect to said first gear means.

* * * * *